United States Patent [19]

Butts

[11] Patent Number: 4,525,613

[45] Date of Patent: Jun. 25, 1985

[54] SPIRAL SPRING KEYBOARD SWITCH WITH HAIRPIN SPRING TACTILE FEEDBACK

[75] Inventor: Gary C. Butts, Huntington Beach, Calif.

[73] Assignee: Apple Computer, Inc., Cupertino, Calif.

[21] Appl. No.: 572,259

[22] Filed: Jan. 20, 1984

[51] Int. Cl.[3] ..... H01H 13/54

[52] U.S. Cl. ..... 200/159 R; 200/159 A; 200/340

[58] Field of Search ..... 200/276, 159 R, 159 A, 200/159 B, 340, 77

[56] References Cited

U.S. PATENT DOCUMENTS

| | | | |
|---|---|---|---|
| 3,742,157 | 6/1973 | Leposavic | 200/159 B |
| 3,773,997 | 11/1973 | Evans et al. | 200/77 |
| 3,819,882 | 6/1974 | Anderson et al. | 200/159 A |
| 3,928,736 | 12/1975 | Drage | 200/159 A |
| 3,969,595 | 7/1976 | Johnson | 200/159 B |
| 4,027,122 | 5/1977 | Bevacqua | 200/77 |
| 4,145,589 | 3/1979 | Albrechtsen | 200/159 R |
| 4,409,448 | 10/1983 | Matsui et al. | 200/153 LA |

FOREIGN PATENT DOCUMENTS

| | | | |
|---|---|---|---|
| 1141450 | 1/1969 | United Kingdom | 200/77 |

*Primary Examiner*—John W. Shepperd

*Attorney, Agent, or Firm*—Blakely, Sokoloff, Taylor & Zafman

[57] ABSTRACT

An improved switch assembly is disclosed, having particular application as part of a key in a computer keyboard. The switch includes a housing including a base, having electrical contacts secured above the base of the switch housing. A generally flat and deformable electrically conductive spring having a central area with outwardly extending spiral arms is disposed above the electrical contacts. A keystem is slidably mounted for longitudinal movement within the housing above the flat spiral spring. A user activates the switch by depressing a key cap mounted to the keystem, which deforms the spiral spring downward and forcing a portion of the spring against the electrical contact, thereby completing the circuit. The keystem includes outwardly extending tapered cam nubs. A "hairpin" cam spring is provided which in an inactive state rests in an oversize slot below the outwardly extending keystem cam. The depression of the key cap forces the tapered cam to spread the cam spring. Further depression presents a narrowing of the cam shape such that the cam spring "snaps" upwardly upon encountering the narrower shape. The upward snapping motion of the cam spring provides a positive tactile feel and audible click to the user.

10 Claims, 12 Drawing Figures

SPIRAL SPRING KEYBOARD SWITCH WITH HAIRPIN SPRING TACTILE FEEDBACK

BACKGROUND OF THE INVENTION

1. Field of the Invention

The present invention relates to electrical switches, and more particularly, to switches used in computer keyboard applications.

2. Art Background

In the computing industry, it is quite common to enter data into a computer by means of a keyboard. Typically, the keyboard is comprised of a plurality of discrete switch assemblies coupled to a printed circuit board having circuit pathways or contacts thereon. Upon depressing or activating a switch disposed on the keyboard, an electrical contact is achieved and appropriate data is thereby entered by the user.

As a result of the heavy and continuous demand placed on keyboard switches by frequent use, switches assemblies of this type must be highly reliable and yet cost effective. Numerous attempts to achieve a low cost but reliable keyboard switch have been made in recent years. For example, U.S. Pat. No. 3,979,568 issued Sept. 7, 1976 discloses a keyboard switch assembly having a movable contact supported by helicline legs on a common conductive sheet. An electrical contact is disposed below the movable contact such that the depression by a user of the movable contact forces it to be physically adjacent to the electrical contact disposed below. If capacitive switching is used, the movable contact and the electrical contact need not actually physically touch. However, switches of this type do not achieve the desired cost goals because of the sophisticated electronics required to drive and sense capacitive switches. Mechanical contact switches of this type do not achieve the desired level of reliability since by depressing the key off-center, it is possible that the circular cental key area may not physically contact the electrical contact disposed below and thereby fail to provide an electrical coupling. Moreover, switches of the type disclosed by U.S. Pat. No. 3,979,568 are typically formed on a continuous metal sheet and have particular application for "sandwiched" type keyboards, and are not readily modified for use as discrete key switches.

As will be disclosed below, the present invention provides a simple, but highly reliable and cost effective, keyboard switch assembly with a unique tactile feel which overcomes the inherent disadvantages of prior art devices.

SUMMARY OF THE INVENTION

An improved switch assembly is disclosed, having particular application as part of a key in a computer keyboard. The switch includes a housing including a base, having electrical contacts secured above the base of the switch housing. A generally flat and deformable electrically conductive spring having a central area with outwardly extending spiral arms is disposed above the electrical contacts. A keystem is slidably mounted for longitudinal movement within the housing above the spiral spring. A user activates the switch by depressing a key cap mounted to the keystem, thereby deforming the spiral spring downward and forcing a portion of the spring against the electrical contact thereby completing the circuit.

The keystem includes outwardly extending tapered cam "nubs" disposed opposite one another on the keystem. A "hairpin" cam spring is provided which, in an inactive state, rests in an oversize slot below the outwardly extending keystem cam nubs. The depression of the keystem forces the tapered cam nubs to spread the cam spring. Further depression presents a narrowing of the cam shape, such that the cam spring "snaps" upwardly upon encountering the narrower shape. The upward snapping motion of the cam spring provides a positive tactile feel and audible click to the user.

DETAILED DESCRIPTION OF THE INVENTION

An improved key switch assembly having particular application as part of a key in a keyboard is disclosed. In the following description for purposes of explanation, specific numbers, dimensions, materials, etc. are set forth in order to provide a thorough understanding of the present invention. However, it will be apparent to one skilled in the art that the present invention may be practiced without these specific details.

Figure 1:
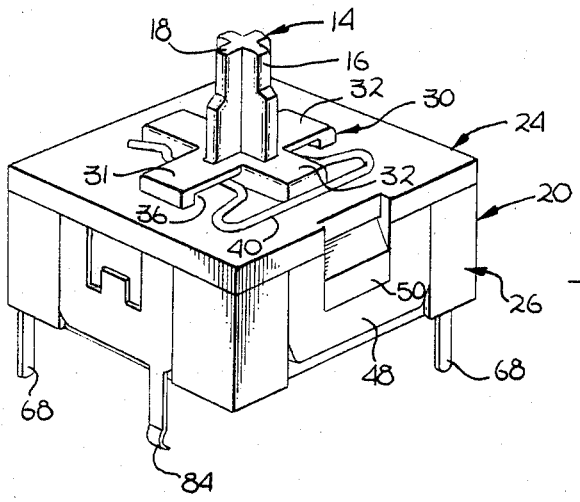
FIG. 1 is a perspective view of the present invention.
Figure 2:
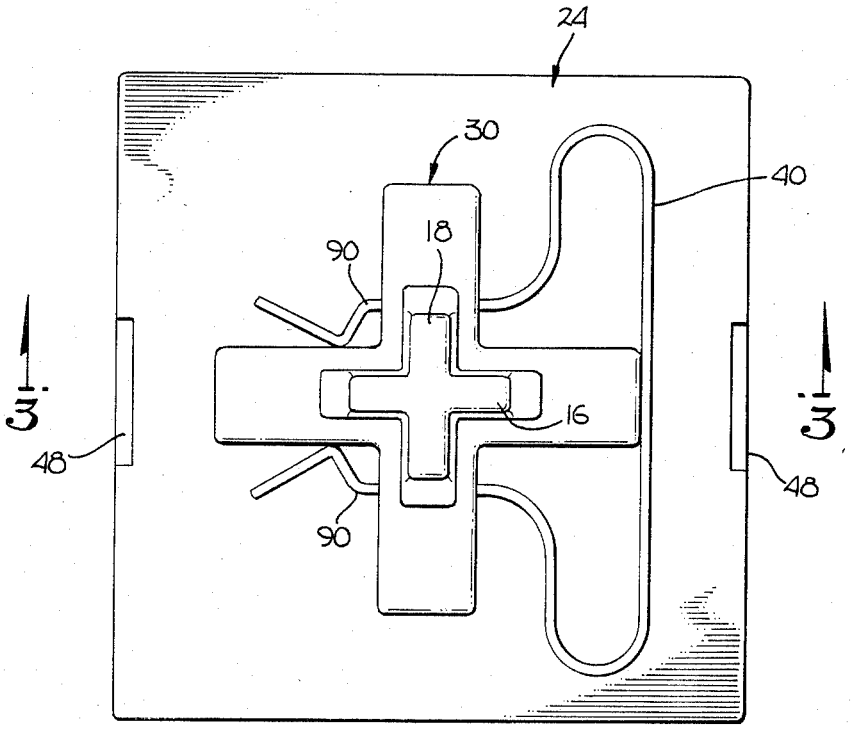
FIG. 2 is a top view of the present invention illustrating the shape and placement of the cam spring.

Referring to FIG. 1, a switch 10 is shown. It will be appreciated from the discussion which follows that switch 10 is particularly adapted for use in keyboards, and that the switch may be used in virtually any application requiring the use of a self contained modular momentary switch. Typically, switch 10 includes a key cap 12 (shown in outline form) on which indicia, for example, alphanumeric characters, may be applied.

The key cap 12 is mounted on a keystem or actuating member 14. As illustrated in FIGS. 1, 2, 3, 4, and 6, keystem 14 is integrally molded from a plastic material, and includes a cross shaped or generally cruciform shape, having first and second outwardly extending cross members 16 and 18, cross members 16 and 18 are uniformly dimensioned and spaced with respect to the axial centerline of the keystem 14. Keystem 14 is slidably moveable vertically within a switch housing 20. One purpose of the first and second outwardly extending cross members is to prevent the keystem from rotating or moving off-center in the housing 20. As shown best in FIGS. 1 and 2, housings 20 is comprised of a cover cap 24 and body 26. The housing 20 may be constructed of any suitable non-conductive material, for example, plastic, nylon or the like. Cover cap 24 includes a raised cross shaped platform area 30 comprising orthogonally disposed raised portions 31 and 32 integrally molded with cap 24. Raised area 30 includes a cross shaped passage, as shown, to permit the keystem 14 to slide longitudinally within the housing 20. The platform area 30 is formed using well known molding techniques from cover cap 24, and is provided with slots 34 and 36 passing through the raised portion 31. As will be described a hairpin shaped cam spring 40 is retained by the slot passages 34 and 36, in order to provide appropriate tactile and audible feedback upon the depression of key cap 12 by a user. As illustrated in FIG. 1, in an assembled configuration, cover cap 24 and body 26 matingly engage and are held in place by press snap members 48 which during assembly snap over ridges 50 located on the exterior surface of the housing body 26.

Figure 3:
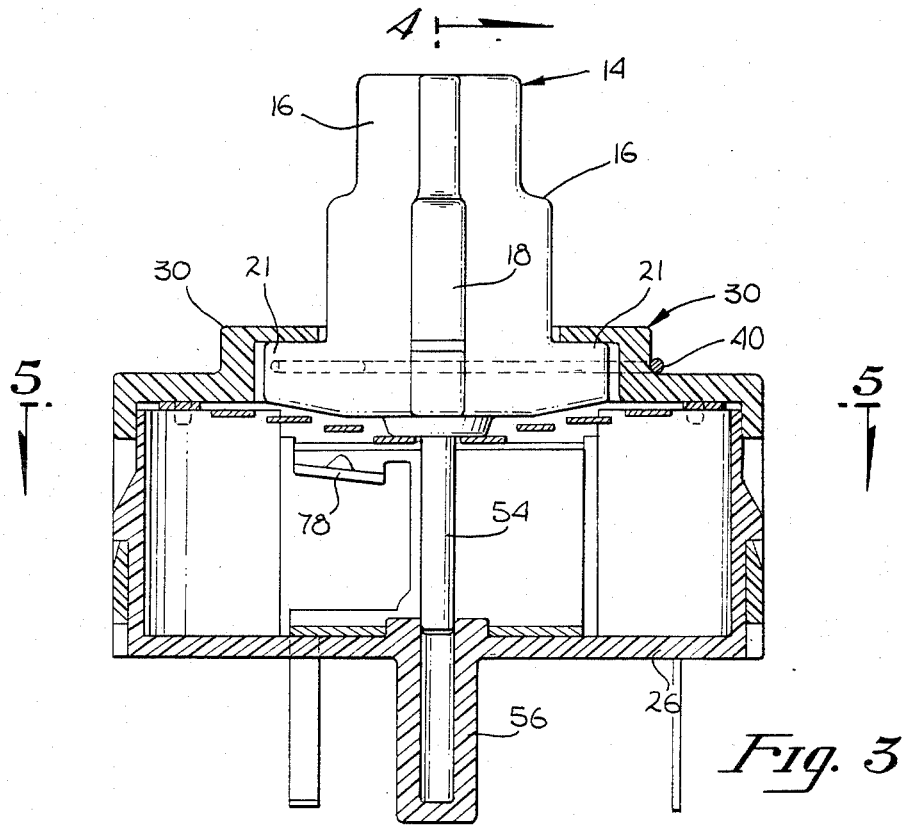
FIG. 3 is a sectional of the present invention view taken along line 3—3 of FIG. 2.
Figure 4:
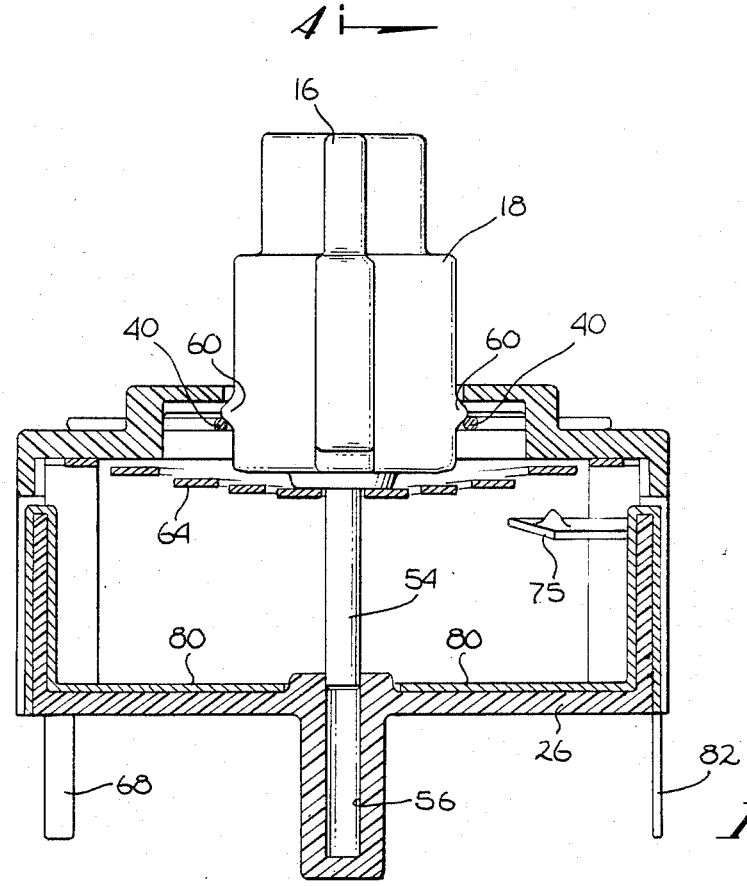
FIG. 4 is a sectional view of the present invention taken along line 4—4 of FIG. 3.

Referring now to FIG. 3, keystem 14 further includes shoulders 21 which are formed as an extension of cross member 16, and limit the upper movement and rotational movement of keystem 14 to the point where shoulder 21 physically contacts the interior surface of the raised portion 32. keystem 14 additionally includes a guide stem 54 which is in alignment with a guide-well 56 formed integrally with the lower portion of body 26. Guide stem 54 is positioned for longitudinal movement within guide 56, such that guide-well 56 insures that guide stem 54 (and thereby keystem 14) remains in proper axial alignment during the depression of key cap 12 by a user. As best illustrated in FIG. 4, keystem 14 further includes outwardly projecting tapered cam nubs 60 which are formed as an extension of cross member 18 defining the keystem. As will be described, the use of cam nub 60, in conjunction with hairpin cam 40, provides a unique tactile feel in key switch operation not found in prior art keyboard switches.

Figure 5:
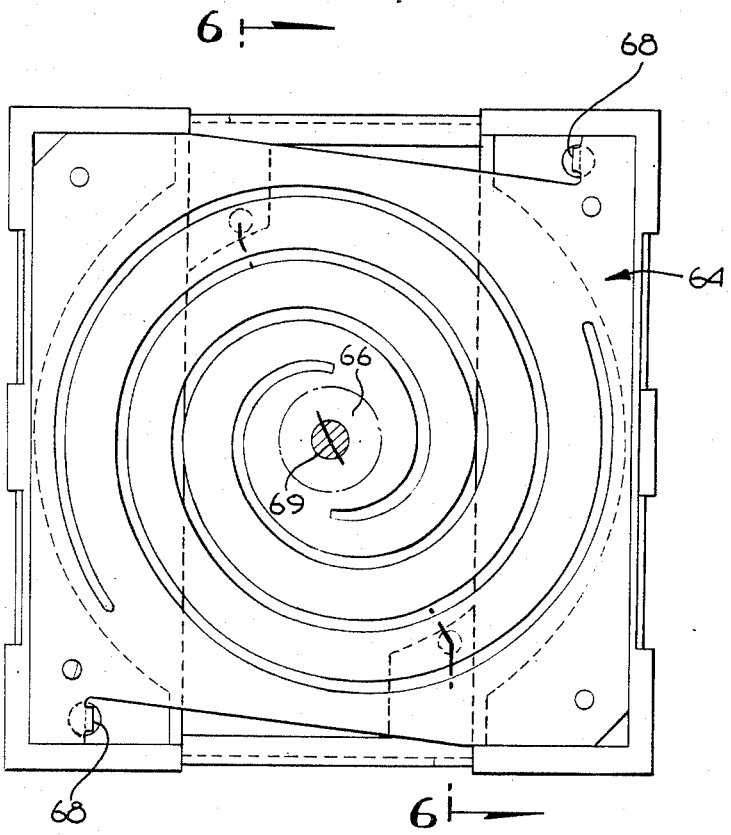
FIG. 5 is a sectional view of the present invention taken along line 5—5 of FIG. 3.

As shown in FIG. 5, a generally flat and deformable electrically conductive spring 64 is provided includes a central area 66 having outwardly extending spiral arms. Spring 64 is formed, in the present embodiment, from a single piece of metallic stock and includes downwardly bent retaining electrical contact legs 68, which pass through passages defined within the housing body 26. As illustrated in FIGS. 1, 3 and 4, spiral spring legs 68 pass through housing body 26 and form one electrical contact of switch 10. Legs 26 may be electrically coupled to other circuit elements in the particular application in which switch 10 is used. As shown, spiral spring 64 is disposed immediately below keystem 14 and includes a central orifice 69 through which guide stem 54 passes during assembly.

Figure 6:
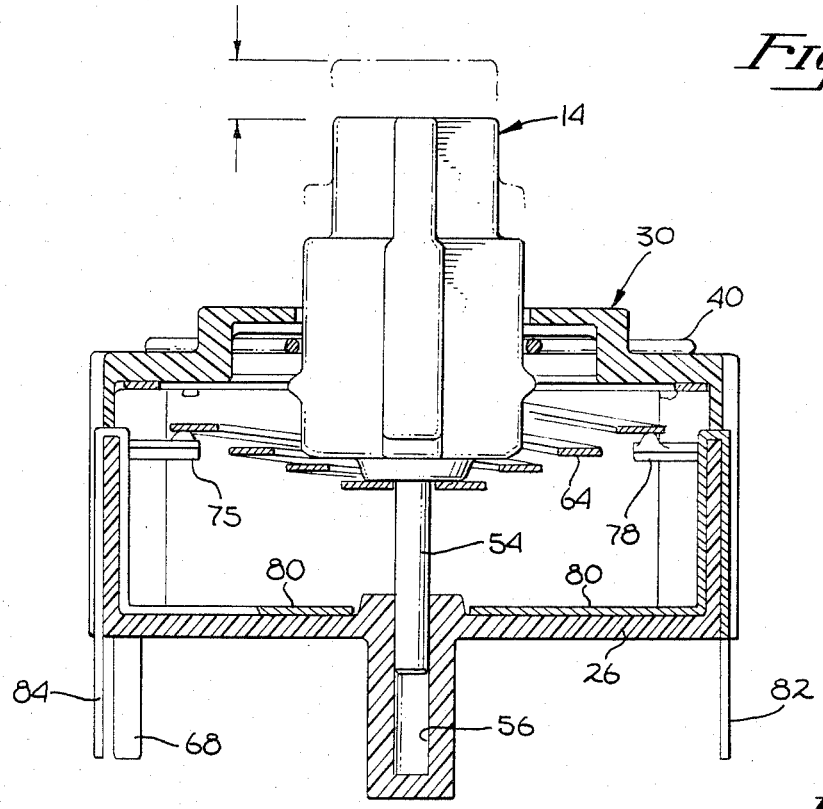
FIG. 6 is a sectional view of the present invention taken along line 6—6 of FIG. 5.

Referring to FIGS. 3, 4 and 6, switch 10 includes first and second generally coplanar electrical contacts 75 and 78, which are formed as an extension of an electrically conductive strip 80 which generally follows the interior contours of housing body 26. In keyboard or other applications where switch 10 is mounted on a printed circuit board or the like, conductive strip 80 is typically formed such that it passes through body 26 (see FIG. 6) to permit switch 10 to be coupled to other elements in a circuit. In the presently preferred embodiment, conductive strip 80 extends outward on opposite sides of housing 20 and forms two leads 82 and 84. The use of two leads reduces the number of jumper connections which must be used when mounting the switch in a keyboard array. As will be described, the depression of keystem 14 results in an electrical coupling of leads 68 and 82 thereby closing a circuit. It will be apparent from the discussion which follows, that although two electrically conductive contacts 75 and 78 are used in the present embodiment, the number of contacts may vary depending upon the internal configuration of switch 10. As illustrated in FIGS. 3 and 4, first and second electrical contacts 75 and 78 are disposed below one or more spiral arms of spiral spring 64, in a spaced apart relationship to the spring 64.

Switch 10 is illustrated in FIGS. 3 and 4 in an inactive state. Thus, electrical contacts 75 and 78 are spaced apart from spiral spring 64, and the keystem 14 is biased upward by the spring 64, such that shoulders 21 of keystem 14 are in physical contact with the interior surface of the raised portion 32 of cover cap 24. In operation, a user desiring to close switch 10 and thereby enter data, depresses key cap 12 forcing keystem 14 downward. The downward motion of keystem 14 applies pressure to the central area 66 of the spiral spring 64, thereby deforming the spiral spring downward. As shown in FIG. 6, the downward motion of keystem 14, and subsequent deformation of the spiral spring 64, forces one or more radial arms of the spiral spring to physically contact electrical contacts 75 and 78, thereby achieving and an electrical coupling between the conductive strip 80 and the electrically conductive flat spiral spring 64. The further depression of the key cap 12 by a user continues to deform the spiral spring 64 additionally, until the downward motion of keystem 14 is limited by the physical contact to guide stem 54 with the bottom of guide well 56. Once the user removes the applied force to the key cap 12, spiral spring 64 once again biases the keystem 14 upward such that the switch returns to its normally inactive state.

Figure 7A:
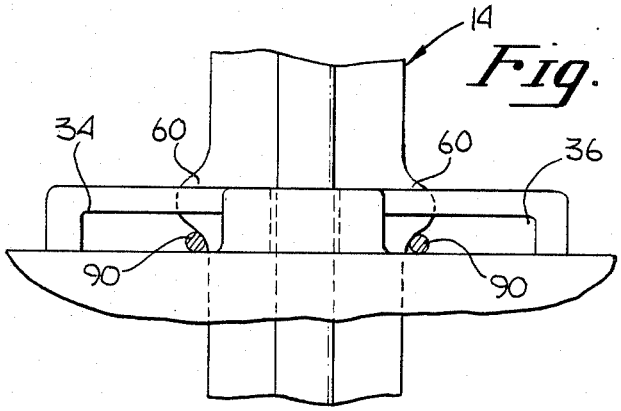
FIGS. 7(*a*)-(*b*), 8(*a*)-(*b*), and 9(*a*)-(*b*) illustrate sequential positions of the keystem cam nubs of the present invention in relation to the snap action hairpin spring, and force versus keystem travel graphs for each illustrated position.
Figure 7B:
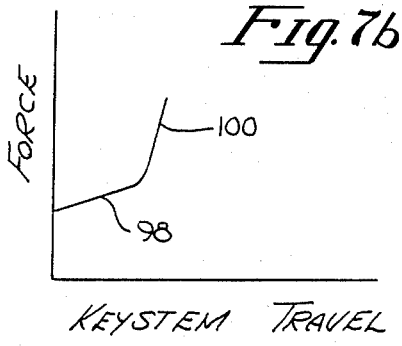
Figure 8A:
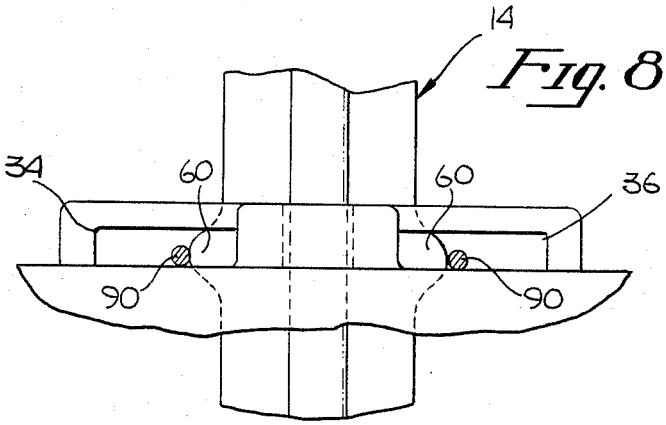
Figure 8B:
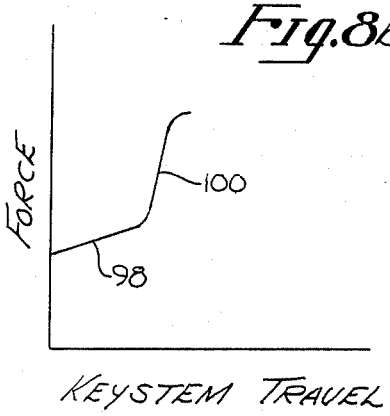
Figure 9A:
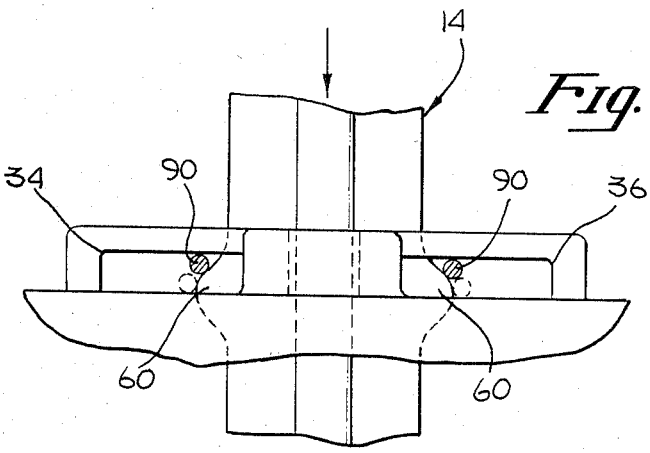
Figure 9B:
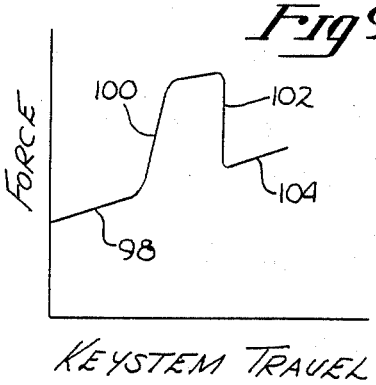

Referring now to FIGS. 7 through 9, the operation of the present invention's hairpin cam 40 to provide the desired tactile and auditory feedback to a user will be described. Cam spring 40 has a generally "hairpin" shape (see FIG. 2) and includes leg portions 90 which extend through slots 34 and 36, respectively. As illustrated, leg portions 90 are normally disposed immediately below, and in physical contact with, cam nubs 60 as shown in FIG. 7(*a*). As shown in FIG. 7(*b*), the initial depression of keystem 14 requires little force on the part of a user, as denoted by line segment 98. The further depression of key cap 12 by a user results in a substantial increase in resistance, and thereby requires increased force in order to continue the depression of keystem 14, as represented by line segment 100 in the graph of FIG. 7(*b*).

The increased force required and illustrated by line segment 100 is due to the force required in order to spread legs 90 of hairpin cam 40 by the cam nubs 60. A generally linear increase in the amount of force required in order to continue the depression of keystem 14 is caused by the expansion of legs 90 of hairpin cam 40 around cam nubs 60. The continued downward motion of the keystem 14 causes a flattening of the required force curve as the legs 90 of hairpin cam 40 approach the peak of the cam nubs 60, as shown in FIGS. 8(*a*) and 8(*b*). Any further downward keystem displacement by the user presents a narrowing of the shape of the cam nubs 60 to the now expanded legs 90 of hairpin cam 40.

Inasmuch as slots 34 and 36 are, as illustrated, greater in height relative to the diameter of the legs 90, legs 90 upon reaching the maximum outward extension of cam nubs 60 may snap in a quick action towards the top of the slots upon encountering the narrowing cam nub shape. This snap action to the top of the slots 34 and 36 reduces all upward force applied by the legs 90 of hairpin cam 40 to zero. In fact, it has been found that the above described snap action provides a net downward force on the keystem nubs 60 by reaction against the top of slots 34 and 36. This force relationship is illustrated by line segments 102 and 104 of FIG. 9(*b*). Accordingly, virtually instantaneously the force of hairpin 40 is transferred from positive to negative, giving the desired "snap" tactile sensation and supplying an audible "click" sound which has been shown to be desirable in keyboard switches.

Thus, an improved switching having particular application computer keyboards has been disclosed. The switch is simple but highly reliable, and provides a switch assembly heretofore not known in the art. Although the preferred embodiment of the invention has been described in detail, it is to be understood that various changes, substitutions, and alterations can be made therein without departing from the spirit and scope of the invention as disclosed above.

I claim:

1. An improved key switch assembly, comprising:

a housing including a base;

a first electrical contact secured to said housing;

spring means secured to said housing, said spring means including a second electrical contact;

actuator means abutting said spring means including a keystem for deforming said spring means in response to the depression of said key by a user, the deformation of said spring means forcing said second electrical contact into contact with said first electrical contact;

said keystem including at least one cam nub extending outwardly from said keystem;

said housing including a snap action hairpin cam spring disposed around said keystem, said hairpin cam spring being deformed in a snap action by said cam nub upon depression of said key, thereby providing tactile feedback to said user.

2. The improved switch assembly as defined by claim 1 wherein said spring means includes a deformable spring disposed above said first electrical contact.

3. The improved switch assembly as defined by claim 2 wherein said spring includes a central area having outwardly extending spiral arms.

4. The improved switch assembly as defined by claim 3, wherein said keystem is slideably mounted for longitudinal movement within said housing.

5. The improved switch assembly as defined by claim 4, further including a third electrical contact disposed opposite and electrically coupled to said first electrical contact below said spring, such that a deformation of said spring forces said arms to contact both said first and third electrical contacts.

6. The improved switch assembly as defined by claim 5 further including first and second leads extending through said housing and coupled to said first and third electrical contacts, respectively, for coupling said switch to a printed circuit board.

7. The improved switch assembly as defined by claim 1 further including a second nub extending outwardly from said keystem disposed opposite said first nub.

8. An improved key switch assembly, comprising:

a housing including a base;

a first electrical contact secured to said housing above said base;

a deformable electrically conductive spring disposed above said first electrical contact, said spring including a central area having outwardly extending spiral arms, at least one of said arms comprising a second electrical contact;

a keystem slideably mounted for longitudinal movement within said housing, said keystem being biased upwardly by said flat spiral spring, the depression of said keystem by a user deforming said flat spiral spring and forcing said second electrical contact to contact said first electrical contact;

said keystem includes at least one cam nub extending outwardly from said keystem;

said housing includes a snap action hairpin cam spring disposed around said keystem, said hairpin cam spring being deformed in a snap action by said cam nub upon depression of said key, thereby providing tactile feedback to said user.

9. The improved key switch assembly defined by claim 8, wherein said spring comprises a metal.

10. The improved key switch assembly defined by claim 8, further including a third electrical contact disposed opposite and electrically coupled to said first electrical contact below said spring, such that the deformation of said spring forces said spiral arms to contact both said first and third electrical contacts.

* * * * *

UNITED STATES PATENT AND TRADEMARK OFFICE

CERTIFICATE OF CORRECTION

PATENT NO. : 4,525,613

DATED : June 25, 1985

INVENTOR(S) : Butts

It is certified that error appears in the above-identified patent and that said Letters Patent is hereby corrected as shown below:

| COLUMN | LINE | |
|---|---|---|
| 1 | 20 | Please delete "switches", second reference, and insert --switch--. |
| 3 | 18 | Please delete "keystem" and insert --Keystem--. |
| 4 | 24 | Please delete "to" and insert --of--. |
| 5 | 7 | Please delete "switching" and insert --switch-- |

Signed and Sealed this

*Fourteenth* Day of *January 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,525,613

DATED : June 25, 1985

INVENTOR(S) : Butts

It is certified that error appears in the above-identified patent and that said Letters Patent is hereby corrected as shown below:

| COLUMN | LINE | DESCRIPTION |
|---|---|---|
| 4 | 20 | Please delete the word "flat". |
| 6 | 26 | Please delete the word "flat". |
| 6 | 27 | Please delete the word "flat". |

Signed and Sealed this

*Tenth* Day of *June 1986*

[SEAL]

*Attest:*

DONALD J. QUIGG

*Attesting Officer*

*Commissioner of Patents and Trademarks*